United States Patent [19]

Gauvry

[11] Patent Number: 4,742,617

[45] Date of Patent: May 10, 1988

[54] SCISSORS HAVING AN OBLIQUELY ORIENTED THUMB LOOP WITH LIMITED DAMPENED FLEXIBILITY

[76] Inventor: Glenn A. Gauvry, 6100 Henry Ave., Apt. 7-N, Philadelphia, Pa. 19128

[21] Appl. No.: 54,970

[22] Filed: May 28, 1987

[51] Int. Cl.[4] ..... B26B 13/00

[52] U.S. Cl. ..... 30/232; 30/298; 30/341

[58] Field of Search ..... 30/232, 254, 271, 298, 30/341

[56] References Cited

U.S. PATENT DOCUMENTS

| | | | |
|---|---|---|---|
| 187,713 | 2/1877 | Kelly . | |
| 242,000 | 5/1881 | Klaucke . | |
| 440,436 | 11/1890 | Pearsall . | |
| 1,108,572 | 8/1914 | Gordon | 30/232 |

*Primary Examiner*—Douglas D. Watts
*Attorney, Agent, or Firm*—Sperry, Zoda & Kane

[57] ABSTRACT

A scissors having first and second members movable with respect to one another to facilitate cutting and including a conventional handle as well as an obliquely oriented thumb loop. The thumb loop is oriented approximately 45 degrees downwardly and 45 degrees laterally with respect to the axis of the handle to which it is attached. The thumb loop also allows for flexible rotational movement of approximately 45 degrees and flexible vertical movement of approximately 45 degrees. The loop is held in position by a flexible connecting member having a flexible intermediate section to allow for the desired movement as well as allowing for return of the thumb loop to the steady state position upon release.

19 Claims, 1 Drawing Sheet

SCISSORS HAVING AN OBLIQUELY ORIENTED THUMB LOOP WITH LIMITED DAMPENED FLEXIBILITY

BACKGROUND OF THE INVENTION

1. Field of the Invention

The present invention pertains to the field of cutting devices, and in particular, scissors which include two adjacent blades which are movable toward and away from one another responsive to opening and closing of the fingers of the user with respect to the thumb of the user. Most prior devices utilize a conventional loop for the thumb and finger openings whereas the present invention pertains to those devices using variously oriented thumb holes or openings.

2. Description of the Prior Art

Many patents have been granted on devices having non-standard thumb and finger gripping apertures to facilitate usage thereof such as U.S. Pat. Nos. 187,266 issued February of 1877 to George for Sheep-Shears; 187,713 issued Feb. 27, 1877 to Kelly on Reversible Scissors; 242,000 issued May 24, 1881 to Klaucke on Scissors; 430,677 issued June 24, 1890 to Pearsall on Shears; 440,436 issued Nov. 11, 1890 to Pearsall on Shears; 590,330 issued Sept. 21, 1897 to Nolen on Scissors Or Shears; 919,211 issued Apr. 20, 1909 on Barber's Shears; 1,479,908 issued Jan. 8, 1924 to Goshia on Scissors; 2,158,277 issued May 16, 1939 to Dolph on Shears; 2,640,264 issued June 2, 1953 to Sullivan et al on a Thumb Guide Shear Handle; 2,744,324 issued May 8, 1956 to Chuba on Barber Shears; 4,146,961 issued Apr. 3, 1979 to Pinto on Scissors; 4,184,249 issued Jan. 22, 1980 to Megna et al on a Scissors-Like Tool; 4,254,551 issued Mar. 10, 1981 to Megna et al on a Scissors-Like Tool; 4,642,895 issued Feb. 17, 1987 to Gauvry on Scissors With Adjustable Thumb Loop and British Pat. No. 20,501 issued Sept. 16, 1911 to Clough on Improvements In Scissors.

SUMMARY OF THE INVENTION

The present invention provides a scissors having an obliquely oriented thumb loop with limited dampened flexibility. The scissors includes a first member having a first blade at one end thereof and a first handle at the other end thereof to facilitate grasping. The scissors further includes a second member having a second blade at one end thereof and a second handle at the other end thereof with the second member being pivotally secured to the first member at a point between the second blade means and the second handle means. The point of securement to the first member is at a point between the first blade means and the first handle means. The first and second blade means are positioned adjacent to one another to facilitate cutting therebetween. The second handle also defines a handle axis extending longitudinally therethrough.

A first gripping means is secured to the first handle means to facilitate gripping of the first handle means by the fingers of a user. A second gripping means is secured to the second handle means to facilitate securement with limited dampened movement of the thumb of a user with respect to the second handle means.

The second gripping means further includes a thumb loop positioned adjacent to the second handle means and being adapted to receive the thumb of a user positioned therein. This thumb loop defines a hole extending axially therethrough which defines a central axis.

The central axis of the thumb loop is oriented at preferably 45 degrees downwardly in a vertically extending plane and approximately 45 degrees laterally in a horizontal extending plane with respect to the handle axis of the second handle means.

A flexible connecting member is secured with respect to the thumb loop and with respect to the second handle means to control relative movement therebetween. This flexible connecting member includes a first end of rigid material fixedly secured with respect to the thumb loop and a second end of rigid material fixedly secured with respect to the second handle means. A flexible intermediate section is located between the first end and the second end to allow limited flexing of the central axis of the thumb loop approximately 45 degrees in either direction within the vertically extending plane and also to allow flexing of the central axis of the thumb loop approximately 45 degrees in either direction within a horizontally extending plane thereof.

Preferably the flexible intermediate section which allows limited flexing includes a reduced diameter central section to aid in providing this element of flexibility. Preferably also the flexible connecting member itself is of a resilient rubber material to facilitate return to the steady state condition after removal of the thumb of a user.

The first end of the flexible connecting member is preferably cemented with respect to the thumb loop to facilitate securement therewith. Similarly the second end of the flexible connecting member is preferably cemented with respect to the second handle means for fixed securement therewith.

To further aid in securement of the flexible connecting member the thumb loop may define a first securement aperture therein and the first end of the flexible connecting member may include a first securement protrusion member thereon adapted to extend into the first securement aperture to facilitate firm securement between the first end of the connecting member and the thumb loop when cemented with respect to one another.

Furthermore, the second handle means may define a second securement aperture therein and the second end of the flexible connecting member may include a second securement protrusion member thereon which is adapted to extend through the second securement aperture to facilitate firm securement between the second end of the connecting member and second handle means when cemented with respect to one another.

Preferably the first and second members of the present invention are of a stainless steel material to facilitate sharpening of the blade means located thereon and to further minimize maintenance thereof. A French lip may be secured with respect to the first handle means to facilitate gripping by the user. Also a rubber bumper may be positioned between the first handle member and the second handle member to limit movement of these members with respect to one another. This stop member is preferably of a resilient rubber material.

It is an object of the present invention to provide a scissors having an obliquely oriented thumb loop with limited dampened flexibility wherein a thumb loop is initially oriented obliquely with respect to the axis of the handle secured thereto to adapted to the normal position of a user's thumb.

It is an object of the present invention to provide a scissors having an obliquely oriented thumb loop with limited dampened flexibility wherein a flexibly resilient member allows limited movement of the thumb loop laterally in a horizontal plane and vertically in a vertical plane with respect to the handle means to which the thumb loop is attached.

It is an object of the present invention to provide a scissors having an obliquely oriented thumb loop with limited dampened flexibility wherein the thumb loop is cemented with respect to the adjacent handle to facilitate securement therewith.

It is an object of the present invention to provide a scissors having an obliquely oriented thumb loop with limited dampened flexibility wherein the first and second main members thereof are made of stainless steel material to minimize maintenance and increase useful life thereof.

It is an object of the present invention to provide a scissors having an obliquely oriented thumb loop with limited dampened flexibility wherein a controlled movable thumb loop is utilized.

It is an object of the present invention to provide a scissors having an obliquely oriented thumb loop with limited dampened flexibility which is easy to use and easy to maintain.

It is an object of the present invention to pfovide a scissors having an obliquely oriented thumb loop with limited dampened flexibility which can be closed completely and gently utilizing a resilient stop means.

It is an object of the present invention to provide a scissors having an obliquely oriented thumb loop with limited dampened flexibility wherein construction is utilized which is relatively simple and inexpensive.

It is an object of the present invention to provide a scissors having an obliquely oriented thumb loop with limited dampened flexibility wherein the thumb can assume the most natural angle and position with relation to any wrist angle.

It is an object of the present invention to provide a scissors having an obliquely oriented thumb loop with limited dampened flexibility wherein a movable thumb piece is usable therewith made of a metal or plastic material.

It is an object of the present invention to provide a scissors having an obliquely oriented thumb loop with limited dampened flexibility wherein cost of maintenance is minimized.

It is an object of the present invention to provide a scissors having an obliquely oriented thumb loop with limited dampened flexibility wherein simplicity of construction greatly minimizes maintenance requirements.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
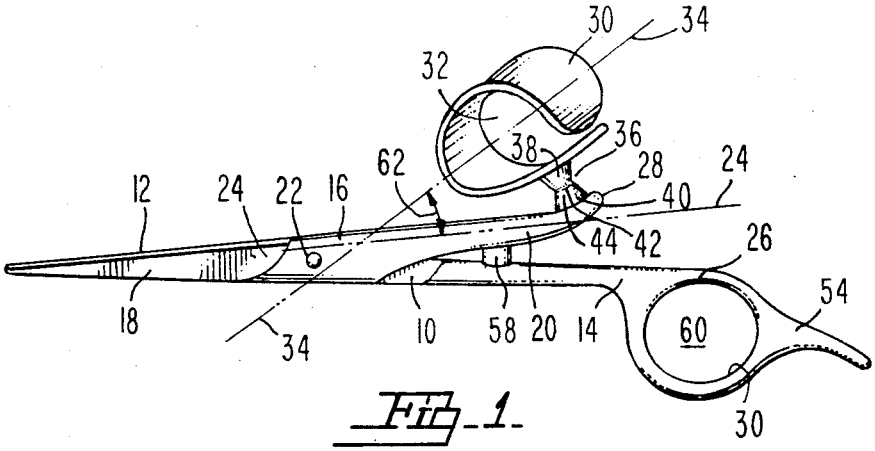
FIG. 1 is a front plan view of an embodiment of the scissors of the present invention.

The scissors of the present invention include a first member 10 pivotally secured with respect to a second member 16. Pivotal securement means 22 secures the generally central portion of the first member 10 with respect to the second member 16. First member 10 includes a first blade means 12 and a first handle means 14. Similarly second member 16 includes a second blade means 18 and a second handle means 20.

First blade means 12 is pivotally secured such as to be movable toward and away from second blade means 18 to facilitate cutting action therebetween. First handle means 14 is positionable moving toward and away from second handle means 20 to facilitate opening and closing of the blade portion of the first member 10 and the second member 16.

The first handle means 14 includes a first gripping means 26 such as a finger loop 60 to facilitate detachable securement of the first handle means 14 with respect to the hand of the user. In a similar manner the second handle means 20 includes a second gripping means 28 thereon through which the thumb of a user can be placed to control movement of second handle means 20. Preferably second gripping means 28 particularly includes a thumb loop 30 secured with respect to the second handle means 20 in such a manner as to be obliquely oriented with respect thereto while allowing a limited amount of dampened flexible movement with respect thereto. Thumb loop 30 defines therein a hole means 32 into which the thumb of a user can be placed for control of movement thereof. Generally cylindrically extending hole means 32 defines a central axis 34 thereof. Also the second handle means 20 defines a handle axis 24 extending longitudinally therethrough.

Figure 2:
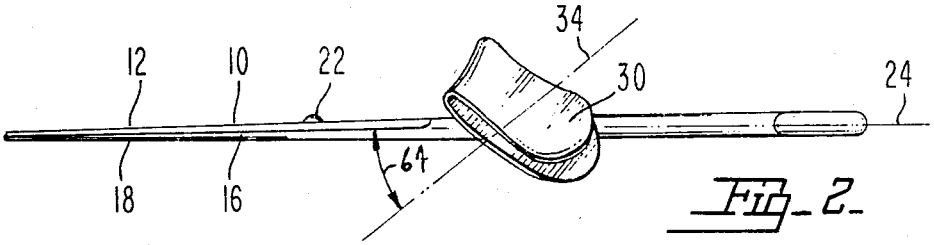
FIG. 2 is a top plan view of the embodiment shown in FIG. 1.
Figure 3:
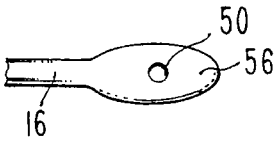
FIG. 3 is a top plan view of an embodiment of the platform of the present invention.
Figure 4:
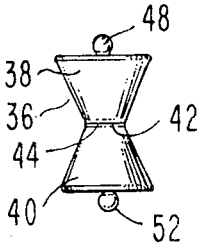
FIG. 4 is a side elevational view of an embodiment of the flexible connecting member of the present invention.
Figure 5:
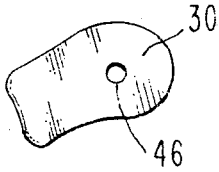
FIG. 5 is a bottom plan view of an embodiment of the thumb loop of the present invention.

The orientation between handle axis 24 and central axis 34 is a particularly novel aspect of the present invention. That is, the central axis 34 of the thumb loop 30 is preferably oriented at close to 45 degrees downwardly in a vertically extending plane as well as approximately 45 degrees laterally in a horizontally extending plane with respect to the handle axis 24 of the second handle means 20. This particular pre-chosen orientation is best shown in FIG. 1. FIG. 1 displays the 45 degree downward angle 62 of the central axis 34 with respect to the handle axis 24 whereas FIG. 2 best shows the laterally inward oriented relative position and angle 64 of the central axis 34 with respect to the handle axis 24. It has been shown that in the relaxed state of the human hand when initiating operation of scissors in general with one of the fingers extending through the finger loop 60 that the natural position of the thumb of the user is somewhat close to this doubly oblique angle of the thumb loop 30 of the present invention.

A flexible connecting member 36 is positioned between the thumb loop 30 and the second gripping means 28 in such a manner as to allow some limited flexibility of the thumb loop with respect to the second gripping means 28. This limited flexibility may allow a flexing of as much as 45 degrees laterally in the horizontal plane or vertically in the vertically extending plane extending coincidentally through a handle axis 24.

To control this flexible yet dampened movement the flexible connecting member 36 is preferably of a resilient material such as rubber or the like. Flexible connecting member includes a first end 38 which may be of a relatively firm material secured with respect to the thumb loop 30. Similarly a second end 40 also preferably of a more firm material may be secured with respect to the second gripping means 28. To facilitate this securement the second gripping means 28 may include a securement platform 56 defined thereon. The flexible connecting member 3 will also preferably include a flexible intermediate section 42 positioned between the first end 38 and the second end 40 which may include a reduced diameter central section 44 to provide the dampened and limited movement flexibility desired in the flexible connecting member 36 especially when the first end 38 and the second end 40 are chosen of a firmer or hardened material. There are many structures which will provide the limited dampened flexibility of the present invention and will function completely and efficiently as the flexible connecting member 36 and the embodiment disclosed in the present invention is merely one possible such configuration.

To facilitate attachment of the thumb loop with respect to the first end 38 of flexible connecting member 36 a first securement aperture 46 may be defined in thumb loop 30. A first securement protrusion member 48 may also be defined on the first end 38 of flexible connecting member 36 which is adapted to extend through the first securement aperture 46 of thumb loop 30 to facilitate securement therebetween. This securement may be further strengthened by the usage of cement as conventionally available therebetween.

A second securement aperture 50 may be defined in the second handle means 20 and a second securement protrusion member 52 may be defined in the second end 40 in such a manner that the second securement aperture 50 is oriented to receive the second securement protrusion member 52 extending therethrough to facilitate securement therebetween. Also the second end 40 and the securement platform 56 of the second gripping means 28 may be cemented with respect to one another. To facilitate control of movement of the apparatus of the present invention a French lip 54 may be positioned extending rearwardly and integral with respect to the first gripping means 26. Also for further control a rubber bumper 58 can act as a stop means to limit the amount of movement of the first handle means 14 and the second handle means 20 toward one another. In this manner there will not be any over extending of the movement of the first blade means 12 and the second blade means 18 with respect to one another.

In operation the user will initially place one of his fingers through the finger loop 60 of the first handle means 14 and then will place his thumb through the thumb loop 30 which is alreadY oriented downwardly and laterally with respect to the axis of the second handle means 20. Then depending upon the geometry of the hand of the user it may be preferable for the thumb to be oriented slightly differently than the pre-set orientation defined by the flexible connecting member 36. Since this member will allow some element of flexibility the thumb loop 30 will automatically be allowed to be movable with flexible damp movement to the pre-defined orientation of the thumb of the user with respect to the fingers of the user. Once usage is completed and the hand of the user is removed from the scissors the thumb loop 30 will return to the steady state position wherein the axis thereof is inclined downwardly and laterally at approximately 45 degrees next being capable of usage again with the same user or with a different user whose hand geometry may be different.

Thus the present invention provides a thumb loop 38 which is initially oriented in the pre-chosen natural position for most users but which is capable of slight movement to accommodate variously sized hands. Also the interconnection between thumb loop 30 and the second gripping means 28 is dampened and limited to the extent that full control of operation of the scissors is possible even with the configuration which allows initial flexibility of the thumb loop with respect to the scissors configuration.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A scissors having an obliquely oriented thumb loop with limited dampened flexibility comprising:

(a) a first member including a first blade means at one end thereof and a first handle means at the other end thereof;

(b) a second member including a second blade means at one end thereof and a second handle means at the other end thereof, said second member being pivotally secured, at a point between said second blade means and said second handle means, to said first member, at a point between said first blade means and said first handle means, with said first and second blade means adjacent to one another to facilitate cutting therebetween, said second handle means defining a handle axis extending longitudinally therebetween;

(c) a first gripping means secured to said first handle means to facilitate gripping of said first handle means by the fingers of a user;

(d) a second gripping means secured to said second handle means to facilitate securement with limited dampened movement of the thumb of a user with respect to said second handle means, said second gripping means comprising:

(1) a thumb loop positioned adjacent said second handle means and adapted to receive the thumb of a user therein, said thumb loop defining hole means therethrough which defines a central axis extending axially therethrough, said central axis of said thumb loop being oriented at approximately 30 to 60 degrees downwardly in a vertically extending plane and 30 to 60 degrees laterally in a horizontally extending plane with respect to said handle axis of said second handle means; and (2) a flexible connecting member secured with respect to said thumb loop and with respect to said second handle means to control relative movement therebetween, said flexible connecting member comprising:

(a) a first end fixedly secured with respect to said thump loop;

(b) a second end fixedly secured with respect to said second handle means;

(c) a flexible intermediate section located between said first end and said second end to allow flexing of said central axis of said thumb loop approximately 60 degrees in either direction within a vertically extending plane, said flexible intermediate section also allowing flexing of said central axis of said thumb loop approximately 60 degrees in either direction within a horizontally extending plane.

2. A scissors having an obliquely oriented thumb loop with limited dampened flexibility as defined in claim 1 wherein said central axis of said thumb loop is oriented at approximately 45 degrees downwardly in a vertically extending plane and 45 degrees laterally in a horizontally extending plane with respect to said handle axis of said second handle means.

3. A scissors having an obliquely oriented thumb loop with limited dampened flexibility as defined in claim 1 wherein said first end and said second end of said flexible connecting member are inflexible.

4. A scissors having an obliquely oriented thumb loop with limited dampened flexibility as defined in claim 1 wherein said flexible intermediate section includes a reduced diameter central section to provide required flexibility.

5. A scissors having an obliquely oriented thumb loop with limited dampened flexibility as defined in claim 1 wherein said flexible intermediate section is made of a flexibly resilient rubber material.

6. A scissors having an obliquely oriented thumb loop with limited dampened flexibility as defined in claim 5 wherein said flexible intermediate section includes a reduced diameter central section to provide required flexibility.

7. A scissors having an obliquely oriented thumb loop with limited dampened flexibility as defined in claim 1 wherein said first end of said flexible connecting member is cemented with respect to said thumb loop for fixed securement therewith.

8. A scissors having an obliquely oriented thumb loop with limited dampened flexibility as defined in claim 1 wherein said second end of said flexible connecting member is cemented with respect to said second handle means for fixed securement therewith.

9. A scissors having an obliquely oriented thumb loop with limited dampened flexibility as defined in claim 1 wherein said thumb loop defines a first securement aperture therein and wherein said first end of said flexible connecting member includes a first securement protrusion member thereon adapted to extend through said first securement aperture to facilitate firm securement between said first end of said connecting member and said thumb loop.

10. A scissors having an obliquely oriented thumb loop with limited dampened flexibility as defined in claim 1 wherein said second handle means defines a second securement aperture therein and wherein said second end of said flexible connecting member includes a second securement protrusion member thereon adapted to extend through said second securement aperture to facilitate firm securement between said second end of said connecting member and said second handle means.

11. A scissors having an obliquely oriented thumb loop with limited dampened flexibility as defined in claim 1 wherein said first member and said second member of the scissors are of a stainless steel material.

12. A scissors having an obliquely oriented thumb loop with limited dampened flexibility as defined in claim 1 wherein said first handle means includes a French lip means attached integrally therewith.

13. A scissors having an obliquely oriented thumb loop with limited dampened flexibility as defined in claim 1 wherein said second handle means includes a securement platform adapted to facilitate securement of said second end of said flexible connecting member thereto.

14. A scissors having an obliquely oriented thumb loop with limited dampened flexibility as defined in claim 1 wherein said first handle means includes a rubber bumper means extending outwardly therefrom toward said second handle means to dampen movement of said first and second handle means toward one another.

15. A scissors having an obliquely oriented thumb loop with limited dampened flexibility as defined in claim 1 wherein said second handle means includes a rubber bumper means extending outwardly therefrom toward said second handle means to dampen movement of said first and second handle means toward one another.

16. A scissors having an obliquely oriented thumb loop with limited dampened flexibility as defined in claim 1 wherein said flexible connecting member is made of a flexibly resilient material to facilitate return of said thumb loop to the steady state position in relation to said second handle means after usage of the scissors.

17. A scissors having an obliquely oriented thumb loop with limited dampened flexibility as defined in claim 1 wherein said flexible intermediate section of said flexible connecting member limits flexing of said central axis of said thumb loop approximately 45 degrees in either direction within a vertically extending plate and further limits flexing of said central axis of said thumb loop approximately 45 degrees in either direction within a horizontally extending plane.

18. A scissors having an obliquely oriented thumb loop with limited dampened flexibility as defined in claim 1 wherein said first handle means includes a finger loop.

19. A scissors having an obliquely oriented thumb loop with limited dampened flexibility comprising:

(a) a first member of stainless steel including a first blade means at one end thereof and a first handle means at the other end thereof, said first handle means including a finger loop and a French lip to facilitate grasping thereof by a user;

(b) a second member of stainless steel including a second blade means at one end thereof and a second handle means at the other end thereof, said second member being pivotally secured, at a point between said second blade means and said second handle means, to said first member, at a point between said first blade means and said first handle means, with said first and second blade means adjacent to one another to facilitate cutting therebetween, said second handle means defining a handle axis extending longitudinally therethrough, said second handle means including a platform means defining a second securement aperture therein;

(c) a first gripping means secured to said first handle means to facilitate gripping of said first handle means by the fingers of a user;

(d) a second gripping means secured to said second handle means to facilitate securement with limited dampened movement of the thumb of a user with respect to said second handle means, said second gripping means comprising:

(1) a thumb loop positioned adjacent said second handle means and adapted to receive the thumb of a user therein, said thumb loop defining hole means therethrough which defines a central axis extending axially therethrough, said central axis of said thumb loop being oriented at approximately 45 degrees downwardly in a vertically extending plane and 45 degrees laterally in a horizontally extending plane with respect to said handle axis of said second handle means, said thumb loop defining a securement aperture therein; and (2) a flexible connecting member of flexibly resilient rubber material to facilitate return of said thumb loop to the steady state position in relation to said second handle means after usage of the scissors, said flexible connecting member being secured with respect to said thumb loop and with respect to said second handle means to control relative movement therebetween, said flexible connecting member comprising:

(a) a non-flexible first end fixedly cemented with respect to said thumb loop, said first end including a first protrusion member thereon adapted to extend through said first securement aperture defined in said thumb loop to facilitate securement thereto;

(b) a non-flexible second end fixedly cemented with respect to said second handle means, said second end including a second protrusion member thereon adapted to extend through said second securement aperture defined in said platform means to facilitate securement thereto;

(c) a flexible intermediate section located between said first end and said second end and including a reduced diameter section to allow flexing of said central axis of said thumb loop approximately 45 degrees in either direction within a vertically extending plane, said flexible intermediate section also allowing flexing of said central axis of said thumb loop approximately 45 degrees in either direction within a horizontally extending plane.

(e) a stop means of resilient rubber material positioned between said first handle means of said first member and said second handle means of said second member to control abutment therebetween.

* * * * *